United States Patent [19]

Clerc

[11] Patent Number: 5,045,754

[45] Date of Patent: Sep. 3, 1991

[54] PLANAR LIGHT SOURCE

[75] Inventor: Jean-Frédéric Clerc, Saint Egreve, France

[73] Assignee: Commissariat a l'Energie Atomique, France

[21] Appl. No.: 480,582

[22] Filed: Feb. 15, 1990

[30] Foreign Application Priority Data

Feb. 15, 1989 [FR] France ..... 89 01960

[51] Int. Cl.[5] ..... H01J 29/00

[52] U.S. Cl. ..... 313/495

[58] Field of Search ..... 313/495, 497, 581, 583, 313/595, 591, 586; 350/345

[56] References Cited

U.S. PATENT DOCUMENTS

| | | | |
|---|---|---|---|
| 4,126,384 | 11/1978 | Goodman et al. | 350/345 |
| 4,274,028 | 6/1981 | Frame | 313/495 |
| 4,377,769 | 3/1983 | Beatty et al. | 313/495 |
| 4,429,303 | 1/1984 | Aboelfotoh | 313/586 |
| 4,580,877 | 4/1986 | Washo | 350/345 |
| 4,772,885 | 9/1988 | Uehara et al. | 350/345 |

FOREIGN PATENT DOCUMENTS

| | | |
|---|---|---|
| 2437661 | 4/1980 | France . |
| 2438337 | 4/1980 | France . |

*Primary Examiner*—Donald J. Yusko
*Assistant Examiner*—John Giust

[57] ABSTRACT

A planar light source, comprises a vacuum enclosure (1) bounded by two parallel, insulating planar walls (3,4) and a side wall (2). On each of the planar walls and within the enclosure (1) is placed a conductive electrode (5,6) covered with an insulating layer (7,8) and at least one of these two wall-electrode-insulating layer assemblies is transparent. On one of the insulating layers (8) is placed a cathodoluminescent material layer (9). In the vicinity of the side wall (2) and externally of the two conductive electrodes (5,6) is provided an electron source (11) and a voltage source (10) is also provided for alternatively applying to the two conductive electrodes (5,6) two different potentials ($V_{anode}$, $V_{rest}$), so that the electrons emitted by the electron source are alternatively collected by the electrodes.

1 Claim, 1 Drawing Sheet

FIG. 1
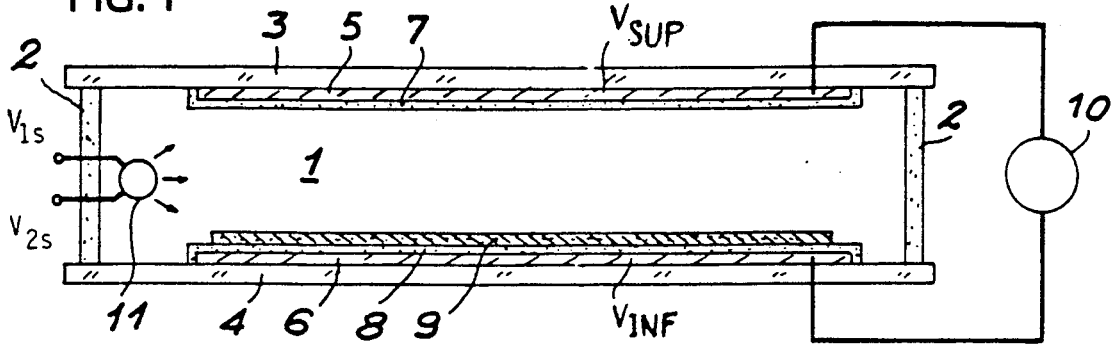
FIG. 2a
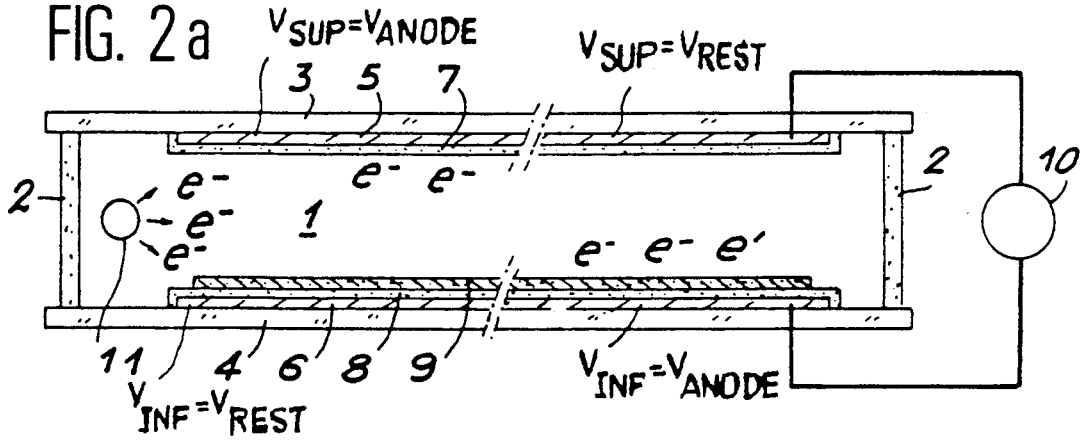
FIG. 3
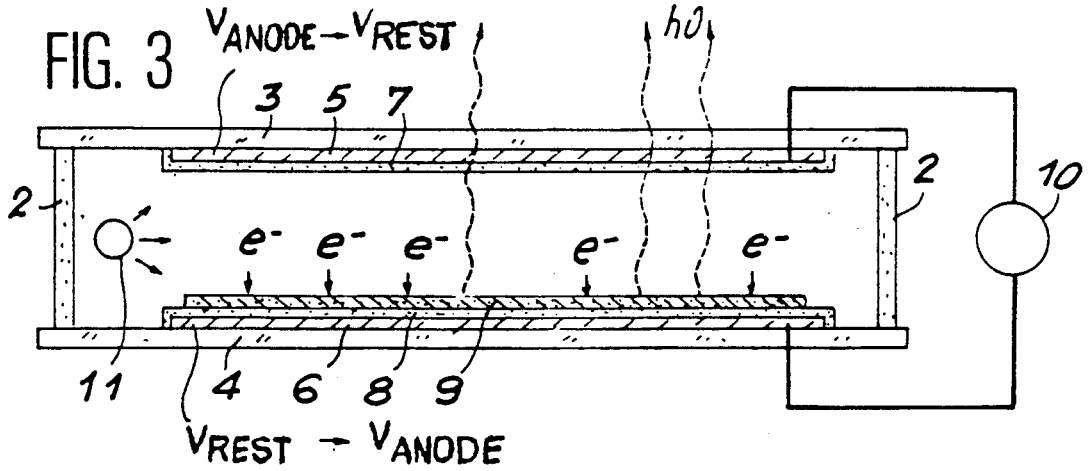
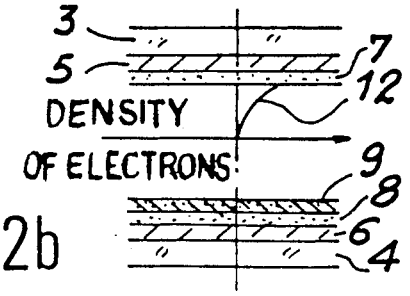
FIG. 2b
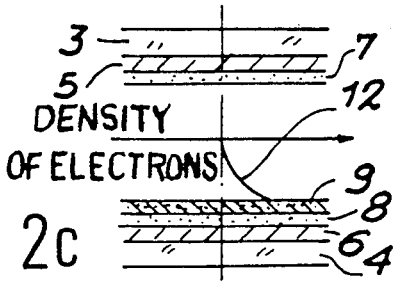
FIG. 2c

PLANAR LIGHT SOURCE

BACKGROUND OF THE INVENTION

The present invention relates to a planar light source and more generally to the construction of extensive planar sources of limited thickness like those used for the rear lighting or illumination of display units (liquid crystal screen), the rear illumination of photographic films, etc.

Up to now for obtaining planar light sources of a certain extension, there has mainly been used two different methods.

The first method consists of using fluorescent sources and particularly in the form of tubes, which are juxtaposed in varying numbers. In practical terms, use is made of fluorescent tubes of the discharge tube type, which are juxtaposed. This leads to illuminating surfaces, which do not have an adequate lighting uniformity and whose thickness is at a minimum approximately 1 cm, in view of the minimum dimensions of the commercially existing fluorescent tubes.

The second method consists of using electroluminescent sources. Unlike in the case of fluorescent sources, there are electroluminescent sources constituted by plates, but these devices have a very poor efficiency and they give off a relatively large amount of heat to obtain a particular lighting intensity. Moreover, such devices have a limited life. The two aforementioned disadvantages have hitherto considerably limited the use of electroluminescent sources apart from very specific applications, such as night-time uses.

The present invention relates to a planar light source, which can easily be produced using simple means and which leads to a device having a limited thickness (approximately 2 mm) and a high brightness (several thousand candelas per square meter) with a very good lighting uniformity and a very long life.

SUMMARY OF THE INVENTION

The present invention therefore relates to a planar light source, characterized in that it comprises a vacuum enclosure bounded by two parallel, insulating, planar walls and a side wall, on each of the planar walls and within the enclosure is placed a conductive electrode covered with an insulating layer and at least one of these two wall-electrode-insulating layer assemblies is transparent, on one of the insulating layers is placed a cathodoluminescent material layer, in the vicinity of the side wall and externally of the two conductive electrodes is provided an electron source and a voltage source is also provided for alternatively applying to the two conductive electrodes two different potentials ($V_{anode}$, $V_{rest}$), so that the electrons emitted by said electron source are alternatively collected by said electrodes.

As has been seen, the planar light source according to the invention utilizes the cathodoluminescence effect, already used e.g. in cathode ray tubes of television sets. A material is said to be cathodoluminescent when, under the effect of a bombardment by electrons having a certain kinetic energy, it emits light radiation. Such known cathodoluminescent materials are often called "phosphors".

According to the invention, a conventional cathodoluminescent material covers the inner face of one of the armatures of a planar capacitor, the corresponding electrode being constituted by a conductive material covered with an electrically insulating layer, as is the electrode of the opposite armature of the planar capacitor.

When the source according to the invention is constructed for illuminating from one of its planar walls, at least the corresponding wall and the electrode and the insulating material located on said wall must be transparent, i.e. permit the passage of light emitted by cathodoluminescence. When this source is constructed in order to illuminate from its two planar walls, the latter and the electrodes, together with the corresponding insulating materials must be transparent.

Within the vacuum enclosure containing the capacitor armatures is provided a per se known electron source (heated filament, points, etc.), which makes it possible, after placing the armature chosen as the anode under a high voltage, to charge the aforementioned planar capacitor by depositing electrons placed in the form of a cloud of negative electricity in the vicinity of said anode, the insulating material deposited on the electrode preventing these negative electric charges from flowing through the anode. When the charge of the capacitor is produced in this way, if electrons are oscillated by a voltage source alternatively applying to the two conductive electrodes two different potentials, so that the electrons are alternatively collected by these electrodes, the electrons then oscillate at the frequency of the signal applied between the armatures in the zone separating the same, thus bringing about an excitation of the cathodoluminescent material which they strike during each cycle, so that light is emitted. In the stable operating state, the electron source in the vacuum enclosure essentially no longer supplies current, except in order to compensate at all times the electron leaks by electrical faults in the insulants, whilst maintaining the same at a constant number.

The electron source can either be a hot source (heated filament) or a cold source (photoemission, field effect).

According to the invention, the number of electrons oscillating in the light source corresponds to the capacitance of the thus produced planar capacitor and is therefore entirely determined by the dimensions of the capacitor, the thickness of the insulants and the voltage applied to the armatures. It is not dependent on the emission characteristics of the auxiliary electron source used. In other words, during permanent operation, the light sensation felt by an observer of the source is consequently only dependent on the oscillating frequency, because the light quantity emitted during each cycle is constant. This ensures the uniformity of the illumination produced by cathodoluminescence.

One of the advantages of the planar light source according to the invention is that its structure is perfectly compatible with the production of planar sources of limited thickness (up to 2 mm) and with a very extensive surface (e.g. several square decimeters without difficulty).

As the electrons which oscillate between the two armatures of the source are used on a large number of occasions, the energy expended for producing them with the aid of the electron source can be made very small.

The planar light source according to the invention is able to emit with a very high brightness, which can be regulated both by the voltage imposed on the armatures and the frequency of the source, two parameters influencing said brightness in an approximately linear manner.

Finally, a by no means insignificant advantage of this light source is that it has a very long life, being essentially the same as that of the cathodoluminescent material placed under the optimum operating conditions (potential difference of approximately 1 to a few kilovolts and good electrical insulation).

BRIEF DESCRIPTION OF THE DRAWINGS

The invention is described in greater detail hereinafter with reference to an embodiment of the planar light source according to the invention and the attached drawings, wherein is shown:

FIG. 1 a general circuit diagram of a planar light source according to the invention.

FIGS. 2(*a*)-(*c*) the charging phase of the planar capacitor of the source with the aid of the auxiliary electron source; FIG. 2*a* the distribution of the charges depending on whether the upper electrode (left-hand part) or the lower electrode (right-hand part) is chosen as the anode; FIG. 2*b* the density distribution of the electrons on the anode constituted by the upper electrode; and FIG. 2*c* the density distribution of the electrons when the lower electrode is chosen as the anode.

FIG. 3 the principle of emitting light during potential reversal between the two conductive electrodes of the source.

DESCRIPTION OF PREFERRED EMBODIMENTS

FIG. 1 shows in a vacuum enclosure 1 bounded by a side wall 2 and two planar walls, which are parallel and transparent and e.g. made from glass, namely upper wall 3 and lower wall 4, the elements of a planar light source according to the invention and which have a transparent conductive electrode 5 located within enclosure 1 on wall 3; a conductive electrode 6 within enclosure 1 on wall 4; two insulating material layers 7,8 respectively covering the conductive electrodes 5,6 and on one of the armatures, in this case the lower armature, a cathodoluminescent material layer 9. A voltage generator 10 makes it possible to control the potential of electrodes 5 and 6.

The device is completed by the electron source 11, e.g. of the heating filament type to whose terminals are applied the voltages $V_{1s}$ and $V_{2s}$.

In the embodiment of FIG. 1, the side walls 3 and 4 are constituted by glass plates tightly sealed on side wall 2.

The upper glass substrate 3 is covered with a transparent conductor 5, constituted by tin-doped indium oxide, having a thickness of approximately 1000 Angstroms, whilst the insulating layer 7 covering conductor 5 is a silica layer with a thickness of approximately 5 micrometers.

The lower glass substrate 4 is covered with a metal conductor 6. When, as is the most general case, said conductor 6 does not have to be transparent, it can be constituted by an aluminium deposit with a thickness of approximately 1000 Angstroms. Conductor 6 carries a thin insulating film 8 made, like the homologous layer 7, by an approximately 5 micrometer thick silica deposit. On insulating film 8 is located a cathodoluminescent material layer 9, produced either by screen process printing from a powder, or by direct thin film deposition with a thickness of approximately 1 micrometer. One of ordinary skill in the art is well aware of cathodoluminescent materials usable in the present invention and he can e.g. use europium-doped yttrium oxysulphide $Y_2O_2S$ to obtain a light emission in the red or a copper and aluminium-doped zinc sulphide ZnS for a light emission in the green, or a silver-doped zinc sulphide ZnS for a light emission in the blue.

According to the invention the electron emitting source 11 can be produced from any known material, such as e.g. heated filaments emitting by the thermoelectric effect, conductive micropoints emitting by the field effect and films emitting by the photoemissive effect.

The assembly shown in FIG. 1 is provided with electrical connections to the outside making it possible:

1) to raise the transparent electric conductor 5 on the upper wall 3 of the source to a potential called $V_{sup}$;
2) to raise the metal conductor 6 deposited on the lower wall 4 to an electric potential $V_{inf}$;
3) the electron source 11 can be connected to one or more potentials, which must be lower than $V_{sup}$ or $V_{inf}$, In the case where the source is constituted by a heated filament, two connections (case shown in FIG. 1) connect it to the outside and are respectively subject to potentials $V_{1s}$ and $V_{2s}$. In the case where the source is constituted by micropoints two connections are still necessary, but one is used for the cathode carrying the micropoints and the other for the electron extraction control grid.

In the case where the electron source 11 is constituted by a photoemissive layer, only one connection to the outside is required.

In all cases, one of ordinary skill in the art will know how to use the electron source 11 for obtaining, after having chosen one of the two conductors 5 or 6 as the anode, the charge of the planar capacitor formed by these two same conductors 5 and 6.

The remainder of the text will only refer to the most frequently encountered case, namely that where the electron source 11 is constituted by a heated filament whereof the two ends are raised to the respective potentials $V_{1s}$ and $V_{2s}$.

In the embodiment of FIG. 1, the upper wall 3—conductive electrode 5—insulating layer 7 assembly is transparent and the source only emits on one side. Without passing beyond the scope of the invention, it would also be possible to produce a planar source emitting on both faces by producing the two walls 3,4, the two electrodes 5,6 and the two insulating layers 7,8 from transparent materials.

A description will now be given of the operation of the planar light source as described hereinbefore with reference to FIG. 1 and bearing in mind that the operation has two stages. Firstly there is a stage referred to as the static state during which the voltage source 10 raises electrodes 5,6 to constant potentials and the electron source 11 is used for charging the capacitor formed by the two aforementioned conductive electrodes 5,6. During this static state charging, the source does not emit light radiation. This static state will be described with reference to FIG. 2 (2*a*,2*b*,2*c*). The second stage, called the dynamic state, corresponds to the operating periods of the light emission source and will be described with reference to FIG. 3.

In static state operation during which the capacitor formed by the armatures 5 and 6 is charged, the voltage source 10 supplies constant potentials $V_{sup}$ and $V_{inf}$. FIG. 2*a* shows the two possibilities offered to the user, namely on the left-handside the use of the upper electrode as the anode, the latter being raised to a potential $V_{sup}$ of approximately 1kV ($V_{sup}=V_{anode}$) and the lower electrode 6 is raised to a rest potential $V_{inf}$ differing only very slightly from 0 ($V_{inf}=V_{rest}$), whereas in the right-hand part of FIG. 2*a* the reverse option is shown, where use is made of the lower electrode as the anode ($V_{inf}=V_{anode}$) and the upper electrode is brought to a rest voltage ($V_{sup}=V_{rest}$) These two options are substantially equivalent, except that it is generally preferable to choose the option of the left-hand part of FIG. 2*a* corresponding to the accumulation of the electronic charges on the capacitor armature not having cathodoluminescent material.

On returning to the left-part of FIG. 2*a*, the upper conductor 5 serves as the anode and on putting the electron source 11 into operation, as symbolically indicated in the drawing, it then collects the electrons emitted by said source 11, which operates at potentials $V_{1s}=0$ V and $V_{2s}=5$ V. Under these conditions, source 11 is substantially at the same potential as the lower electrode 6 and the upper electrode 5 serves as the anode and collects the cloud of electrons $e^-$ emitted by source 11. FIG. 2*b* shows the variation 12 of the density of said same electrons in the vicinity of the upper wall 3. Thus, the electrons collected in this way by the upper conductor 5 are not eliminated by the latter, because the insulating layer 7 prevents them from flowing directly into the capacitor circuit. Thus, the same electrons accumulate at the interface between the vacuum of enclosure 1 and the insulating layer 7 until the local potential reaches the same value as the potential of the emissive source. When this condition is fulfilled, the potential in the vicinity of the insulating layer is approximately the same as that applied between the emissive electron source 11 and the upper conductor 5 serving as the anode. Thus, in the chosen example, this potential is approximately 1 kV, which justifies the thicknesses of 5 micrometers chosen for the insulating layers 7 and 8.

Thus, at the end of this charging phase of the capacitor of the source, the number of electrons collected by the upper anode conductor 5 in the state of equilibrium is proportional both to the potential difference between source 11 and the collecting electrode 5 and is the inverse of the thickness of insulant 7, as is the capacitance of the thus formed capacitor.

The right-hand part of FIG. 2*a* and FIG. 2*c* illustrate the symmetrical choice in which the user would have placed the upper electrode 5 at rest and would have chosen to raise the lower electrode 6 to a potential of 1 kV in order to form the anode therefrom. This embodiment will not be described, because it is strictly symmetrical to the previous embodiment and is readily apparent to one of ordinary skill in the art.

On referring to FIG. 3, a description will now be given of the dynamic state of the source, i.e. the state during which, after the preceding static charge phase, there is a periodic reversal of the potentials of the conductive electrodes 5 and 6, in order to obtain the light emission effect by impact of the negative electric charges on the cathodoluminescent layer 9.

If, on the basis of the state of the potential shown in the left-hand half of FIG. 2*a*, there is a reversal of the potentials respectively applied to the upper and lower conductors 5,6, the diagram of FIG. 3 is obtained, in which the electron cloud travels towards the lower electrode 6 and strikes the cathodoluminescent layer 9, thus bringing about the emission of photons h $\nu$ towards the outside of the source. The electrons striking the cathodoluminescent material at the moment of reversing the charge zones lead to the emission of light and it is sufficient for the voltage source 10 to alternatively supply potentials $V_{anode}$ and $V_{rest}$ to electrodes 5 and 6 in order to obtain the periodic phenomenon and bring about the continuous emission of light from the source.

If $Q/mm^2$ is used for designating the charge stored per square millimeter in the vicinity of the collecting electrode, f the reversal frequency of the potentials due to the voltage source 10 between the upper and lower electrodes, the current directed towards the cathodoluminescent material 9 can be written $i=Qf$.

In a practical embodiment of the invention, the insulants 7 and 8 are given thicknesses of 5 micrometers and they are made from a silica with an index of 5, there is a potential difference of 1 kV between the two conductive electrodes and alternative frequency of 1 kHz for the voltage source, which leads to a charge per $mm^2$ close to $10^{-8}$ Coulomb and a charging current of approximately 10 $mA/mm^2$.

Thus, a brightness of several thousand $cd/m^2$ is obtained, bearing in mind the usual conversion efficiencies of the presently used cathodoluminescent materials.

Moreover, the static state described hereinbefore as a phase preceding the dynamic state can be eliminated. The charge Q necessary for operation is then progressively established during the dynamic state.

We claim:

1. A planar light source, characterized in that it comprises a vacuum enclosure (1) bounded by two parallel, insulating, planar walls (3,4) and a side wall (2), on each of the planar walls and within the enclosure (1) is placed a conductive electrode (5,6) covered with an insulating layer (7,8) comprising an assembly and at least one of these two wall-electrode-insulating layer assemblies is transparent, on one of the insulating layers (8) is placed a cathodoluminescent material layer (9), in the vicinity of the side wall (2) and externally of the two conductive electrodes (5,6) is provided an electron source (11) and a voltage source (10) is also provided for alternatively applying to the two conductive electrodes (5,6) two different potentials ($V_{anode}$, $V_{rest}$), so that the electrons emitted by said electron source are alternatively collected by said electrodes.

* * * * *